US006941867B2

(12) United States Patent
Renz et al.

(10) Patent No.: US 6,941,867 B2
(45) Date of Patent: Sep. 13, 2005

(54) INITIATOR WITH A SLIP PLANE BETWEEN AN IGNITION CHARGE AND AN OUTPUT CHARGE

(75) Inventors: Robert N. Renz, Phoenix, AZ (US); Vahan Avetisian, Newbury Park, CA (US); Patrick J. Carroll, Saratoga, CA (US)

(73) Assignee: Special Devices, Inc., Moorpark, CA (US)

( * ) Notice: Subject to any disclaimer, the term of this patent is extended or adjusted under 35 U.S.C. 154(b) by 37 days.

(21) Appl. No.: 10/188,402

(22) Filed: Jul. 1, 2002

(65) Prior Publication Data

US 2005/0115436 A1 Jun. 2, 2005

(51) Int. Cl.[7] ..... F42B 3/10

(52) U.S. Cl. ..... 102/202.9; 102/202.5; 102/202.11

(58) Field of Search ..... 102/202.5, 202.7, 102/202.8, 202.9, 202.14, 202.11

(56) References Cited

U.S. PATENT DOCUMENTS

| | | | | |
|---|---|---|---|---|
| 5,099,762 A | * | 3/1992 | Drapala | 102/202.1 |
| 5,621,183 A | * | 4/1997 | Bailey | 102/202.7 |
| 5,686,691 A | | 11/1997 | Hamilton et al. | 102/202.5 |
| 5,763,814 A | * | 6/1998 | Avory et al. | 102/202.7 |

* cited by examiner

*Primary Examiner*—Aileen Felton
(74) *Attorney, Agent, or Firm*—Law Offices of Thomas J. Brindisi

(57) ABSTRACT

A pyrotechnic initiator having an initiator including a relatively low monolithic ignition charge that is separated from an overlying output charge by an intermediary slip plane. The slip plane may simply be a non-integral junction between monolithic ignition and output charges, or it may be a junction between a monolithic ignition charge and a non-monolithic output charge, or it may be a void or barrier between the ignition and output charges.

21 Claims, 1 Drawing Sheet

INITIATOR WITH A SLIP PLANE BETWEEN AN IGNITION CHARGE AND AN OUTPUT CHARGE

BACKGROUND OF THE INVENTION

The present invention generally relates to the field of pyrotechnic initiators, and more particularly to a pyrotechnic initiator having a slip plane between an ignition charge and an output charge.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators. One advance has been the use of liquids and slurries in loading pyrotechnic charges into the initiators. As shown in U.S. Pat. No. 5,686,691 to Hamilton et al., it is known to load a slurry charge into a conventionally cup-shaped charge can, and to directly affix such a loaded can onto a header assembly so that the charge comes into contact with the header surface and bridgewire. However, this method poses certain drawbacks and difficulties in the loading and proper retention of the charge on the bridgewire.

For example, a monolithic dried slurry charge extending from the header assembly's top surface substantially up to the upper interior surface of the can is prone to moving out of optimal contact with the bridgewire when exposed to environmental and/or physical stresses. The higher the monolithic charge is, the longer the length of the surrounding container (such as a charge can) that is available to receive physical and environmental forces that can be transmitted through the upper region of the monolithic charge and into the lower region of the monolithic charge, where the charge makes contact with the bridgewire. Thus, the height of the monolithic charge increases the forces that are subjected upon the lower region of the charge including its portion contacting the bridgewire. Such increased forces can include direct lateral forces on the charge, which tend to shear the charge away from its position of intimate contact (which is generally provided or at least enhanced through the contraction and/or sealing of the charge around the bridgewire that occurs upon drying of the slurry) with the bridgewire. Such forces may also include torque that is transmitted by the enclosure acting as a lever arm with a pivot at or near its connection to the header assembly (e.g., a circumferential through-weld), thus tending to rip the lower region of the charge up from the top header surface and its attached bridgewire.

It is believed that these problems of such monolithic charges have not been addressed by employing a relatively low monolithic ignition charge that is separated from an overlying output charge by an intermediary slip plane.

SUMMARY OF THE INVENTION

In accordance with the present invention, an initiator includes a relatively low monolithic ignition charge that is separated from an overlying output charge by an intermediary slip plane. The slip plane may simply be a non-integral junction between monolithic ignition and output charges, or it may be a junction between a monolithic ignition charge and a non-monolithic output charge, or it may be a void or barrier between the ignition and output charges.

BRIEF DESCRIPTION OF THE FIGURE

The Figure is a side sectional view of an embodiment of an initiator according to the present invention, showing a slip plane that is formed through a non-integral connection between monolithic ignition and output charges.

DETAILED DESCRIPTION OF A PREFERRED EMBODIMENTS

Figure 1:
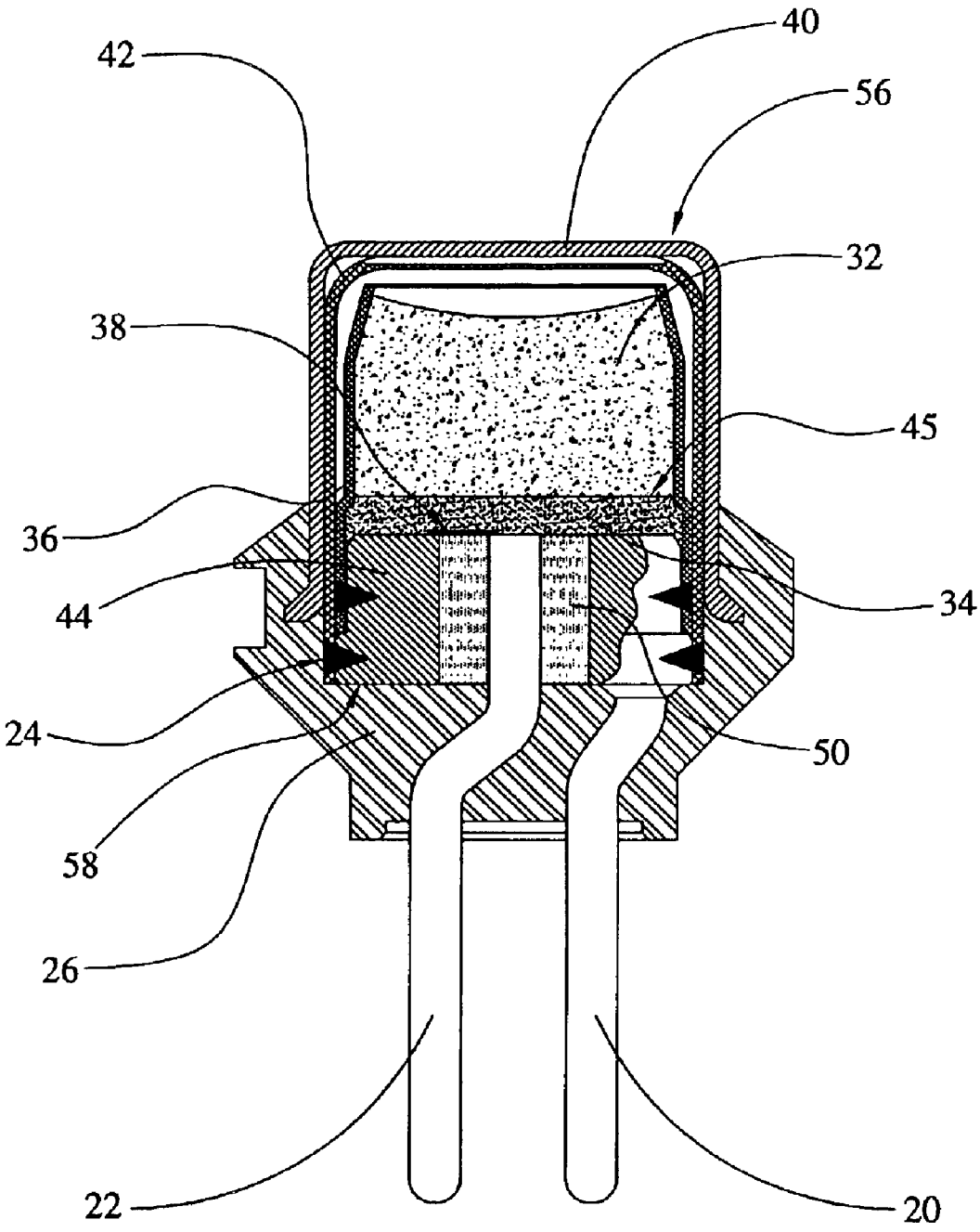

The present description incorporates by reference in full the disclosures of the following co-pending applications that are filed concurrently herewith and assigned to the assignee of the present application: Ser. No. 10/188,004, entitled "Initiator with a Bridgewire in Contact with Slurry-loaded Pyrotechnic Charge at a Position of Relatively Low Void Formation," Ser. No. 10/188,009, entitled "Axial Spin method of Distributing Pyrotechnic Charge in an Initiator," Ser. No. 10/188,010, entitled "Initiator with a Bridgewire Configured in an Enhanced Heat-sinking Relationship," and Ser. No. 10/188,003, entitled "Initiator with an Internal Sleeve Retaining a Pyrotechnic Charge and Methods of Making Same,". U.S. Pat. No. 5,648,634 to Avory et al. is also incorporated herein by reference. Various initiator configurations can be used, or modified appropriately for use, in the prevent invention. As can be seen from the Figure, a preferred embodiment of an initiator 56 according to the present invention preferably includes a number of features typically found in pyrotechnic initiators. For example, there is a glass-to-metal sealed header assembly 58 hermetically attached to a charge can 42 through a circumferential weld 24, an insulator cup 40, and a molded insulating body 26. The depicted header assembly 58 consists of an isolated center pin 22, glass 50, an eyelet 44, a welded bridgewire 38, and a ground pin 20, with both of the pins 20 and 22 extending beyond the body 26 to form a connector end. The eyelet 44 is preferably made of a metal such as 304L stainless steel, and is generally cylindrical with a passage defined through it to permit a feedthrough to be created by the hermetic sealing of the glass 50 and the center pin 32 therein. The depicted header assembly 58 includes a concentrically placed passage, center pin and glass, however, they could alternately be eccentrically placed, or the header could be non-coaxial with two pins each sealed in a feedthrough. The glass 50 may preferably consist of sodium aluminosilicate or barium alkali silicate, and the bridgewire 38 may be formed from a high resistance metal alloy such as platinum-tungsten or "NICHROME" nickel-chromium alloy. The ignition charge 34 (also known as a primer charge) may preferably be zirconium/potassium perchlorate-based and is in a heat-receiving relationship with the bridgewire 38. A firing current having at least a predetermined "all-fire" level and duration (e.g., 800 mA for 2 milliseconds at −35° C.) applied to the pine 20 and 22 resistively generates heat that is reliably (e.g., 99.9999% of the time with at least 95% confidence) sufficient to ignite the charge 34. It is also generally required that the application of current up to a predetermined "no fire" level and duration (e.g., 200 mA for 10 seconds at 85° C.) will reliably not result in the bridgewire generating sufficient heat to ignite the charge 34. As an alternate to the bridgewire 38, a monolithic bridge may be used, and preferably consists of dissimilar conductive materials such as a thick resistive film on a ceramic substrate, a thin resistive film deposited on a ceramic substrate, or a semiconductor junction diffusion doped onto a silicon substrate, examples of each of which are well-known in the art. Output charge 32 may also preferably be zirconium/potassium perchlorate-based.

As can be seen from the Figure, a sleeve 36 having a cylindrical aspect contains the ignition charge 34 and output charge 32 within the initiator, with the ignition charge 34 being retained in place against the top surface of the header assembly 58 so that it is in intimate contact with the bridgewire 38. This sleeve 36 can be formed, for example, from a hollow cylindrical piece of 304L stainless steel having a wall thickness of ten thousandths of an inch, which is then swaged inwardly (using a suitable special-formed tool designed for the application such as is well-known in the art) at its top to form a narrowed top end. The sleeve 36 can then be slid onto the header assembly 58, and preferably has a relatively tight interference fit with the header assembly 58 so as to secure it firmly thereto and reduce any tendency for it to transmit lateral forces or torque on charge 34. For that same reason, the bottom end of the sleeve 36 is preferably welded to the eyelet 44 with a circumferential through-weld, although it can less preferably be swaged into a corresponding circumferential recess or other suitable attachment means can be used. It is noted that although it may provide an additional means of enhancing the robustness of the contact between the bridgewire and ignition charge, the use of an internal sleeve is not required by the present invention.

Following installation of the sleeve 36 in the depicted enbodiment, a suitable pyrotechnic ignition charge 34 is loaded within the sleeve 36 preferably so as to cover the entire exposed top surface of the header assembly 58. (However, one of ordinary skill in the art will readily envisage alternate embodiments, such as one wherein the ignition charge is confined by a dam or the like to a diameter that is smaller than that of the output charge, as is shown in assignee's co-pending application Ser. No. 10/188,003. This is preferably done using a slurry loading technique or similar means known in the art. Some examples of relevant slurry-loadable pyrotechnic compositions are described in U.S. Pat. No. 5,686,691 to Hamilton, et al., the disclosure of which is incorporated herein by reference except to the extent that it contradicts anything explicitly set forth here. For example, a suitable slurry for the ignition charge 34 is disclosed in assignee's co-pending application Ser. No. 10/188,003 which is incorporated herein by reference. The ignition charge 34, which is dried to from a monolithic solid, is preferably loaded to a height that is a small portion of the height of the charge enclosure, preferably 0.010" to 0.080" high, In fact, in a preferred embodiment having a 260 mg total charge weight, the ignition charge may preferably be 30 mg, and results in a very thin layer only 0.040" high. (Using a very thin layer of slurry minimizes void formation and cracking during the drying process, thus creating a more rigid monolithic mass that has enhanced integrity with the bridgewire, which it partly or wholly encapsulates).

The output charge 32 may also preferably be loaded in slurry form right on top of the charge 34 after the charge 32 has dried; alternately, the charge 32 may be loaded as a powder and suitably consolidated. A suitable slurry for the output charge 32 is also disclosed in assignee's co-pending application Ser. No. 10/188,003, which is incorporated herein by reference.

A suitable slip plane 45 above the ignition charge 34, which slip plane serves to prevent the transmission of forces from the output charge 32 into the ignition charge 34, can be created a number of ways. As shown in the Figure, ignition charge 34 can be a monolithic solid, with a likewise monolithic solid output charge 32 above it. In such a case for example, if both the ignition charge and output charge 32 are monolithic dried slurries, their formulations should be selected such that the chemical differences and method of their application ensures they do not integrally adhere to each other at plans 45. In that regard, the solvent and binders noted in assignee's co-pending application Ser. No. 10/188,003 (which is incorporated herein by reference), help prevent integral bonding between the ignition charge 34 and output charge 32. Specifically, for example, the solvent in the output charge should be selected so that it does not readily dissolve the dried ignition binder. Not consolidating the output charge also helps prevent integral bonding between the charges. After it is slurry-loaded, the ignition charge 34 may be centrifuged (e,g., at 300 rpm on an eight inch arm for 0.5 to 1.5 seconds during the dispensing of the slurry, to slightly consolidate it and flatten its top surface, and then after the ignition charge 34 is dried, output charge 32 may be slurry-loaded and the subassembly preferably then axially spun as taught in assignee's co-pending application Ser. No. 10/188,009.

Alternately, the ignition charge 34 may be a monolithic solid (preferably a dried slurry), and the output charge 32 may be non-monolithic (i.e., not structurally solid and integral), such that it is incapable of transmitting forces through the slip plane 45. Alternately still, a void or space (not shown) may be created between the charges 32 and 34 that are both monolithic, thereby creating a slip plane between them through which forces are not transmitted. As yet another alternative, a barrier disc (not shown), for example ten thousandths of an inch thick and made of a suitable plastic or any other suitable chemically compatible material, may be placed between a monolithic ignition charge 32 and a monolithic (or non-monolithic, such as powder) output charge 32 to create a slip plane, as long as it is ensured that the materials are selected so as to prevent integral adhesion of the disc to both charges. However a slip plane is created, all that is essential is that it substantially prevent the transmission of forces having a lateral or torque component from output charge 32 to ignition charge 34. In this regard, it is noted that the slip plane should include an uninterrupted planar component that is parallel to the header top surface and fully extends across the junction between the ignition charge and output charge, in order to prevent the transmission of any lateral forces.

It is noted that other methods or constructing and loading an embodiment of the present invention utilizing a sleeve as taught in assignee's co-pending application Ser. No. 10/188,003 may also be suitable depending on the embodiment and as long as they permit the creation of a suitable slip plane. Also, the bridgewire 38 may preferably be in close contact with the glass 50, and/or may be flattened, as taught in assignee's co-pending application Ser. No. 10/188,010. Assuming a slurry is used to form charge 34, the bridgewire 38 may also preferably be in contact with the charge 34 at a position of the charge 34 that was subject to a relatively high degree of contraction during the slurry drying process, so as to minimize the presence of voids in the charge 34 at the position of the bridgewire 38, as taught in assignee's co-pending application Ser. No. 10/188,004. It is also noted that although the foregoing description of a preferred embodiment refers to the use of a dried slurry charge, a slip plane according to the present invention may be utilized with other ignition charges that comprise a monolithic mass such as one that is retained on the header top surface by the narrowed upper end of a charge sleeve.

After the initiator subassembly (including the header assembly 58 and the sleeve 36 loaded with the ignition charge 34 and output charge 32 separated by a slip plane) has been assembled, it is pressed into and hermetically sealed and attached to the charge can 42 (which preferably may also be 304L stainless steel having a wall thickness of ten thousandths of an inch), such as with a through-weld 24. To complete the initiator 56, a suitable insulator cup 40 (which preferably may be nylon having a wall thickness of ten thousandths of an inch) and insulating body 26 (which may preferably be nylon insert-molded onto the initiator subassembly) may be provided as is well known in the art.

Finally, it is noted that the use of a slip plane in accordance with the present invention may also allow more flexibility in building variable output charge weight initiators based on a common design, without the need for special hardware features such as a charge sleeve having a counterbore.

A preferred embodiment of a pyrotechnic initiator including a relatively low monolithic ignition charge that is separated from an overlying output charge by an intermediary slip plane, has thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. An initiator comprising:

a) a header assembly including an eyelet, a top surface, and an exposed electrical initiating element on said top surface;

b) a monolithic solid ignition charge adjacent to said top surface of said header assembly, said ignition charge being adjacent to and in heat-transferring relationship with said electrical initiating element;

c) an output charge overlying said ignition charge;

an intermediary slip plane between said ignition charge and said output charge, wherein said slip plane is created by a lack of integral connection between said ignition charge and said output charge, wherein said ignition charge and said output charge are in immediate contact with each other over substantially all of said slip plane; and, d) a charge can around said ignition charge and said output charge and hermetically attached to said header assembly so as to separate the interior contents of said can from the ambient environment exterior to said can.

2. The initiator subassembly of claim 1, wherein said electrical initiating element is a bridgewire.

3. The initiator of claim 1, wherein said output charge is non-monolithic and thus incapable of transmitting substantial lateral force components or torque to said ignition charge.

4. The initiator of claim 1, wherein said ignition charge is formed from a slurry that includes a binder at less than five percent by weight and a solvent at between ten to thirty percent by weight.

5. The initiator of claim 4, wherein said ignition charge is a dried centrifuged slurry having a height of no more than a millimeter.

6. The initiator of claim 1, wherein said output charge is a monolithic solid mass.

7. The initiator of claim 6, wherein both of said ignition charge and said output charge are formed of dried slurry.

8. The initiator of claim 1, further comprising a charge sleeve within said charge can, said sleeve projecting upwardly above said top surface of said eyelet and circumferentially surrounding said ignition charge and said output charge.

9. The initiator of claim 8, wherein said charge sleeve has a narrowed top end, and said charge has a largest outer diameter that is greater than the inner diameter of said narrowed top end of said sleeve.

10. The initiator of claim 8, further comprising an ignition charge dam confining said ignition charge, said output charge having a diameter greater than that of said ignition charge.

11. A method for making an initiator, comprising the steps of:

a) providing a header assembly including an eyelet, a top surface, and an exposed electrical initiating element on said top surface;

b) providing a monolithic solid ignition charge adjacent to said top surface of said header assembly and adjacent to and in a heat-transferring relationship with said electrical initiating element;

c) loading an output charge on top of said ignition charge;

d) providing an intermediary slip plane between said ignition charge and said output charge, wherein said slip plane is created by a lack of integral connection between said ignition charge and said output charge, wherein said ignition charge and said output charge are in immediate contact with each other over substantially all of said slip plane; and, e) placing a charge can around said ignition charge and said output charge and hermetically attaching said charge can to said header assembly so as to separate the interior contents of said can from the ambient environment exterior to said can.

12. The method of claim 11, wherein step b) and step c) each include the step of slurry-loading a charge slurry.

13. The method of claim 11, further comprising the step of axially spinning said header assembly.

14. The method of claim 11, further comprising the step of providing a charge sleeve within said charge can and around said ignition charge and output charge.

15. The method of claim 11, wherein said electrical initiating element is a bridgewire.

16. The method of claim 11, wherein said ignition charge is formed from a slurry that includes a binder at less than five percent by weight and a solvent at between ten to thirty percent by weight.

17. The method of claim 16, wherein said ignition charge is a dried centrifuged slurry having a height of no more than a millimeter.

18. The method of claim 11, wherein said output charge is a monolithic solid mass.

19. The method of claim 14, wherein both of said ignition charge and said output charge are formed of dried slurry.

20. The method of claim 14, wherein said charge sleeve has a narrowed top end, and said charge has a largest outer diameter that is greater than the inner diameter of said narrowed top end of said sleeve.

21. The initiator made by the method of claim 11.

* * * * *